United States Patent [19]

Marten

[11] 4,116,468

[45] Sep. 26, 1978

[54] REGISTER TAPE EDITOR

[76] Inventor: Hilda C. Marten, 13560 Ridge Rd., North Huntingdon, Pa. 15642

[21] Appl. No.: 778,937

[22] Filed: Mar. 18, 1977

[51] Int. Cl.[2] ..... B42D 19/00; B65H 17/02

[52] U.S. Cl. ..... 281/7; 242/67.4

[58] Field of Search ..... 242/67.3 R, 67.4, 67.1 R, 242/67.1 D, 67.2, 55, 71.9, 73; 40/86; 281/6, 7, 8, 9, 10, 11, 12, 13, 14

[56] References Cited

U.S. PATENT DOCUMENTS

| | | | |
|---|---|---|---|
| 750,651 | 1/1904 | Hulback | 281/7 |
| 1,230,997 | 6/1917 | Clise | 281/7 |
| 1,525,570 | 2/1925 | Cox | 281/7 |
| 1,538,629 | 5/1925 | Downing | 281/7 |
| 1,548,510 | 8/1925 | Clay | 281/7 |
| 1,710,630 | 4/1929 | Lingle | 281/1 |
| 3,145,943 | 8/1964 | Grant | 242/67.4 |
| 3,552,101 | 1/1971 | Papp | 242/67.3 R |

FOREIGN PATENT DOCUMENTS

| | | | |
|---|---|---|---|
| 227,927 | 1/1925 | United Kingdom | 281/7 |

*Primary Examiner*—George F. Mautz
*Attorney, Agent, or Firm*—Clarence A. O'Brien; Harvey B. Jacobson

[57] ABSTRACT

An editor for various-sized paper rolls used in cash registers, and the like, has a supporting base on which are mounted first and second roller assemblies of different heights. Between the roller assemblies is disposed an inclined reading and notation table arranged for supporting a tape being wound between the roller assemblies, with the inclination of the table being from the higher to the lower of the roller assemblies. The height of the table is variable to accommodate the tape as same is being taken from one roller assembly to the other so as to prevent strain of the tape as it moves over the table. Each of the roller assemblies has a shaft journaled in a split bearing at one end and in a bearing hinged for swinging laterally of the assembly at the other end for permitting a tape to be placed on and removed from the shaft. A disc slidably and lockably disposed on the shaft cooperates therewith to form a spool of various widths for receiving various-sized paper rolls.

12 Claims, 7 Drawing Figures

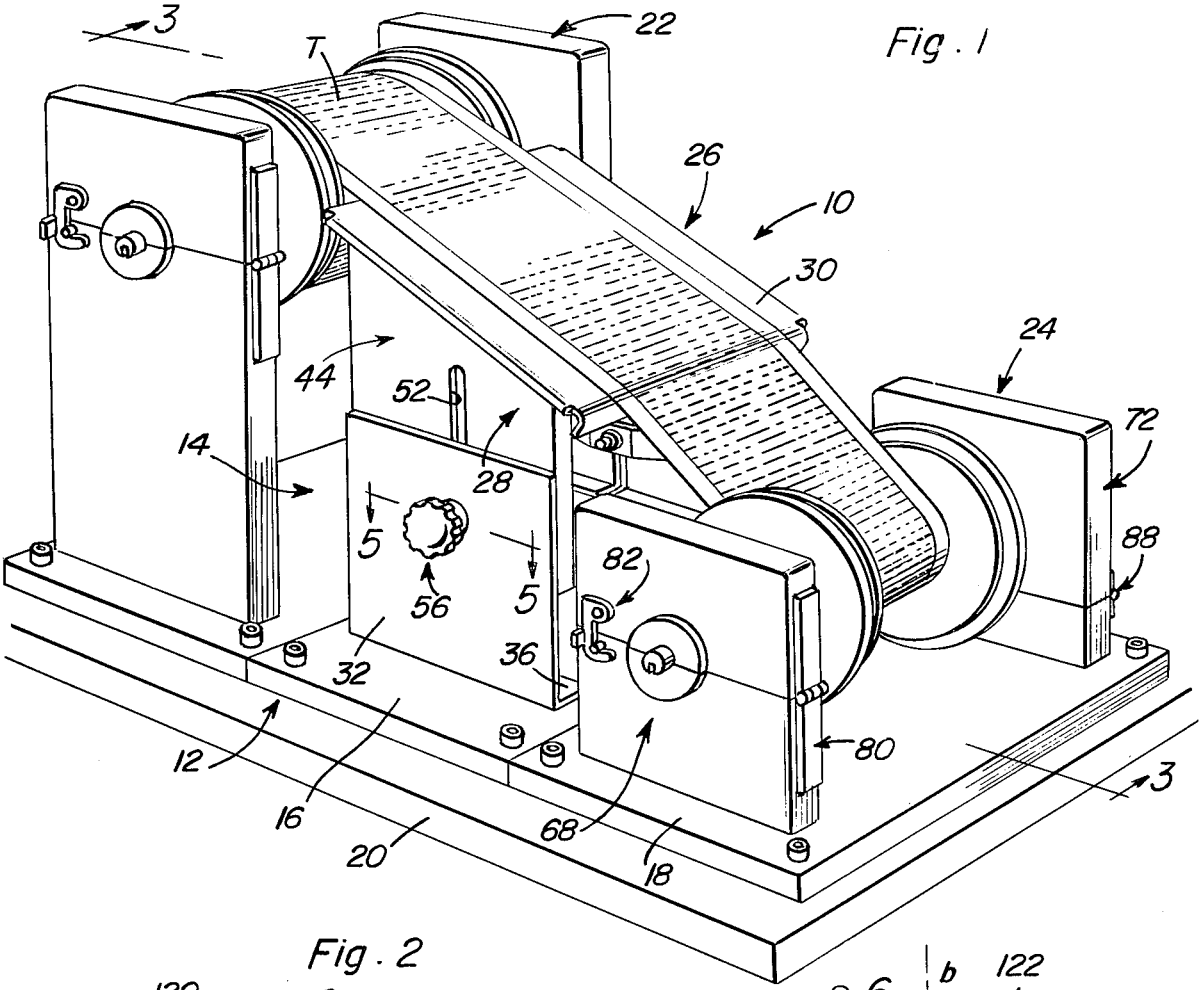
Fig. 1
Fig. 2
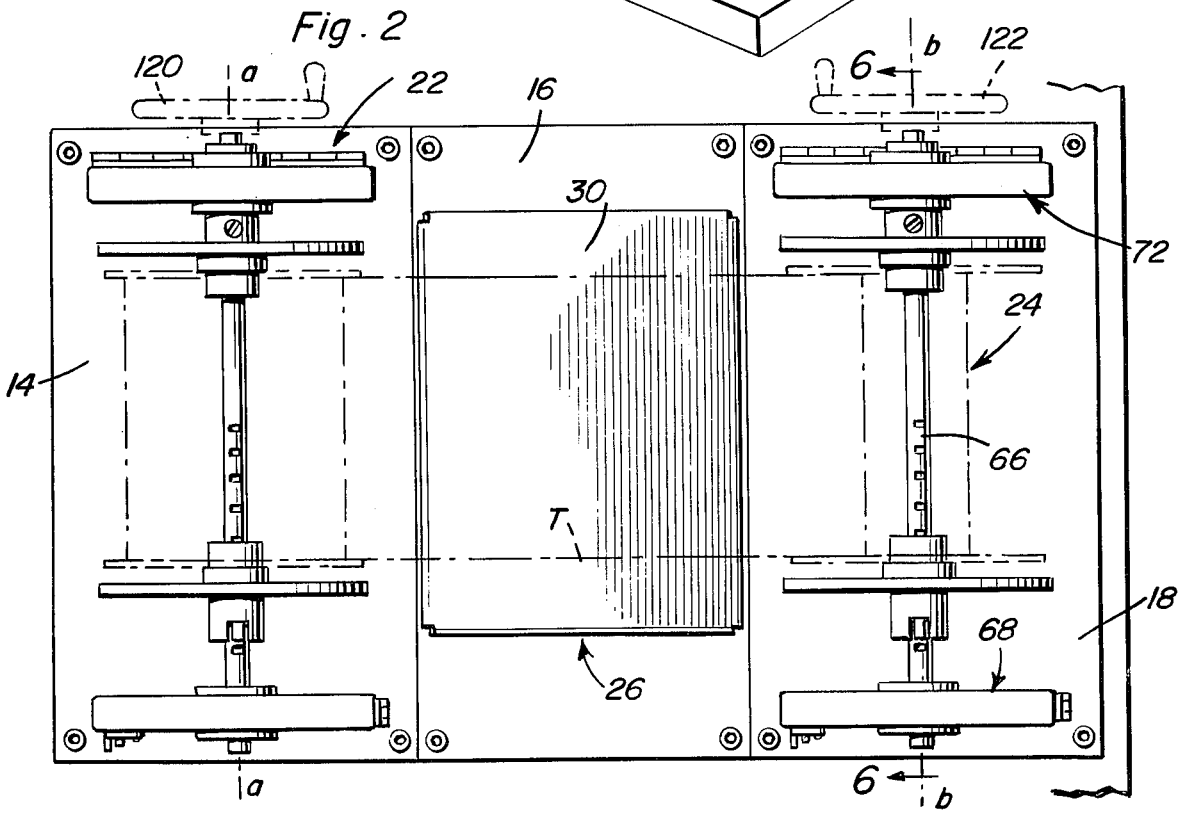

REGISTER TAPE EDITOR

BACKGROUND OF THE INVENTION

1. Field of the Invention

This invention relates generally to a reeling device for tapes, and particularly to a device for facilitating review of various-sized paper rolls, and the like, use in cash registers and similar business machines when bookkeepers are transferring information to permanent ledgers, or when auditors are checking entries made in such permanent ledgers.

2. Description of the Prior Art

Various business machines and scientific recording instruments employ rolls of papers which comes in a considerable variety of widths and diameters depending on the nature, size, and function of the machine. Thus, a device intended to facilitate inspection of such rolls of paper must be able to readily adapt from a wide roll to a narrow roll, and should further be provided with a table suitable for marking the roll as appropriate during review and/or editing of such rolls.

U.S. Pat. No. 3,773,273, issued Nov. 20, 1973 to A. T. Gosnell, discloses a chart roll or paper guide apparatus intended for use with strip charts. In particular, the apparatus of U.S. Pat. No. 3,773,273 employs a pair of parallel rollers having a table disposed between them and a fixed guide disc and an adjustable guide disc provided on each of the rollers for accommodating paper rolls of varying widths. Further, U.S. Pat. No. 875,505, issued Dec. 31, 1907 to M. Clark, and 3,021,041, issued Feb. 13, 1962 to J. Maksymiak et al, disclose roller devices having adjustable guides, with the construction of an indexing mechanism for the adjustable guide disclosed in Pat. No. 875,505 using a leaf spring for selectively retaining the guide at a predetermined position on the associated roller shaft.

U.S. Pat. Nos. 2,346,075, issued Apr. 4, 1955 to J. Mihaly, and 3,447.759, issued June 3, 1969 to B. W. Rau, discloses additional examples of spools capable of being adjusted to accommodate rolls of varying widths.

SUMMARY OF THE INVENTION

It is an object of the present invention to provide a device permitting rapid unreeling and rewinding of printed rolls so that a read-out at any specific point, or for a sequenced number of intervals such as days, can instantly be obtained.

It is another object of the present invention to provide a device capable of permitting rapid positioning of tapes of different widths, such positioning accomplished without need for special tools or the use of screw fasteners and the like.

It is yet another object of the present invention to provide paper-winding apparatus capable of manual or motorized operation as circumstances dictate.

These and other objects of the present invention are achieved by providing a register tape editor having: a supporting base; first and second roller assemblies rotatably mounted in spaced, parallel arrangement on the base; and a reading and notation table disposed between the first and second roller assemblies for supporting a roll to be reviewed and edited, the roll being received by the roller assemblies, the latter winding and unwinding the roll from one of the roller assemblies to the other across the table. The table is advantageously adjustable vertically with respect to the space of the device for permitting a tape support surface of the table to be adjusted to accommodate the tape and prevent undue strain on the length of the tape from the roll which instantaneously extends between the roller assemblies.

One of the roller assemblies has an axis of rotation disposed vertically from the base of the apparatus, distance greater than an axis of rotation of the other of the roller assemblies, while the tape support surface of the table is inclined so as to be adjustable into a plane substantially parallel to a line passing through the axes of rotation of the roller assemblies. By this arrangement, the section of the tape being reviewed in disclosed in a position particularly convenient for the person reviewing the records.

The table preferably further includes a pair of codirectionally extending, spaced stands arranged abutting with and fastened to the base of the device, with the stands disposed extending upwardly toward the tape support surface. Each of the stands is provided with an aperture, while the top portion of the table, which includes the tape support surface, has two substantially parallel legs extending downwardly from the tape support surface and provided with longitudinally extending slots arranged for cooperating with the apertures provided on the stands. Suitable fasteners engage in the aperture and slots for adjustably mounting the top portion on the stands. By arranging the slots so as to extend substantially vertically, it will be appreciated that the height of the inclined tape supporting surface of the table can be readily adjusted as a function of the relative sizes of the rolls formed in each of the roller assemblies.

Each of the roller assemblies advantageously includes a shaft having two ends and journaled on the base of the apparatus for partially forming a spool. A first side wall is mounted on the base so as to extend upwardly therefrom, and has formed therein a split bearing for journaling one of the ends of the shaft. In a similar manner, a second side wall is mounted on and disposed extending upwardly from the base of the device and is provided with a bearing journaling the other of the ends of the shaft. The second side wall, however, is hinged near the base for permitting the second side wall to swing laterally away from the first side wall. By this arrangement, opening of the split bearing of the first side wall will permit the shaft to swing with the second side wall and place the shaft in a position for receiving a paper roll to be reviewed.

Each of the roller assemblies also includes a primary plate and a secondary plate with each of the plates being provided with a shaft receiving hub. The primary plate is affixed to the shaft adjacent the second side wall, while the secondary plate is slidably disposed on the shaft. Suitable locking means are provided on the hub of the secondary plate for selectively restraining same from movement relative to the longitudinal extent, or axis of rotation, of the shaft. Removal of the secondary plate from the shaft permits a paper roll to be placed on or removed from the shaft, and once a paper roll is properly placed on the shaft, the secondary plate may be replaced on the shaft and locked in the necessary position for properly guiding the paper roll.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view showing a register tape editor according to the present invention.

FIG. 2 is a fragmentary, top plan view showing the device of FIG. 1.

DESCRIPTION OF THE PREFERRED EMBODIMENTS

Figure 3:
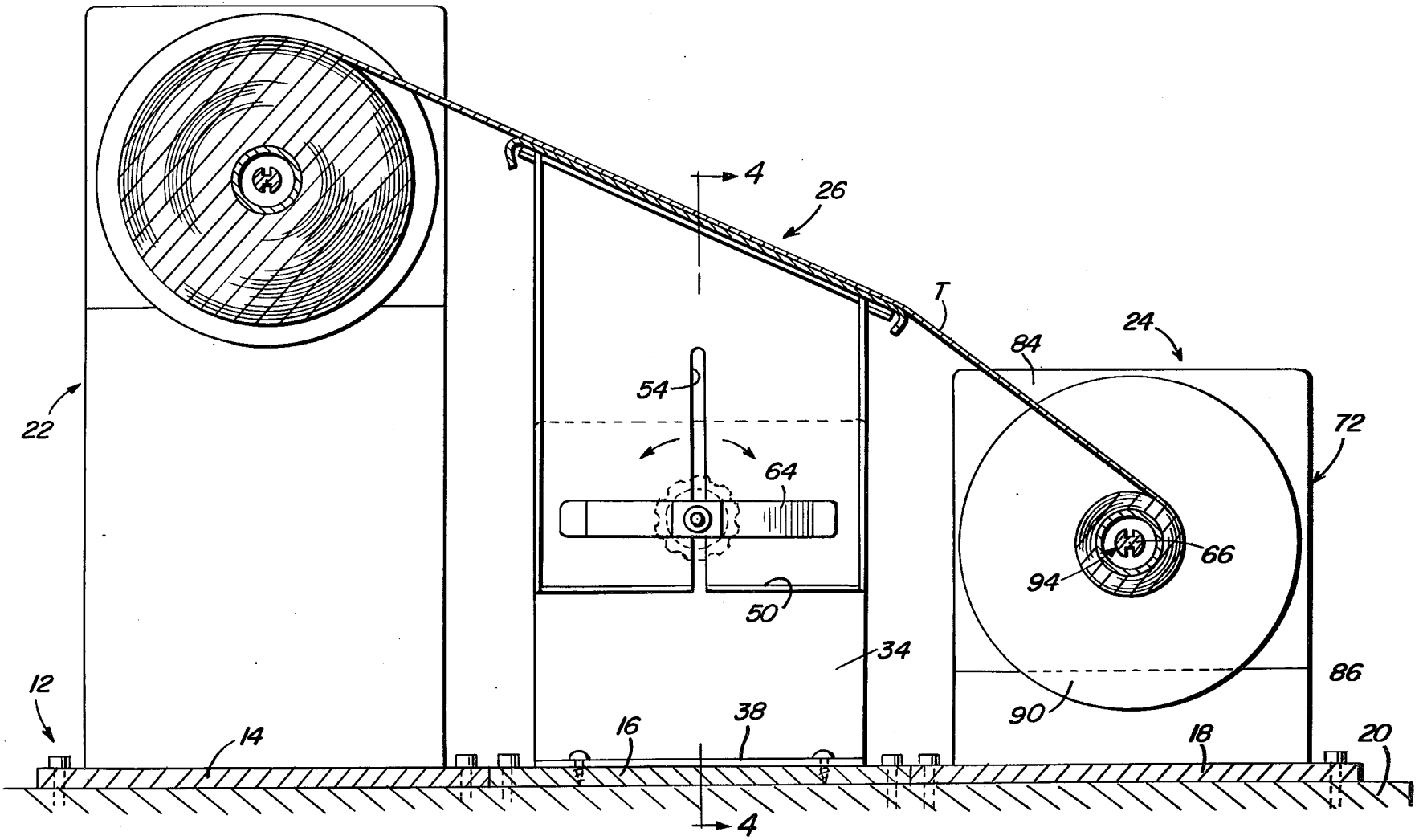
FIG. 3 is an enlarged, sectional view taken generally along the line 3—3 of FIG. 1.

Referring now more particularly to FIGS. 1-3 of the drawings, a register tape editor 10 according to the present invention includes a supporting base 12 advantageously formed in the illustrated three segments 14, 16 and 18 anchored to a suitable platform 20 such as a tabletop, as by conventional screws or bolts. Mounted on segments 14 and 18 are first and second roller assemblies 22 and 24 disposed in spaced, substantially parallel arrangement with respect to one another. Disposed between the roller assemblies 22 and 24 is a reading and notation table 26 supporting a length of a tape T, or a portion or strip of a paper roll, and the like, received by the roller assemblies 22, 24 for winding and unwinding the tape T from one of the assemblies to the other. By this arrangement, the table 26, which is adjustable vertically with respect to base 12, will permit notations to be made on tape T, as well as prevent excessive strain on the tape while same is being reviewed.

Roller assembly 22 has an axis of rotation of the spool thereof disposed vertically from base 12 a greater distance than an axis of rotation of roller assembly 24, with table 26 including a top portion 28 forming an inclined tape support surface 30 arranged substantially parallel to a line passing through the axes of rotation of roller assemblies 22 and 24. These axes of rotation are designated as *a-a* and *b-b*, respectively, in FIG. 2.

Figure 4:
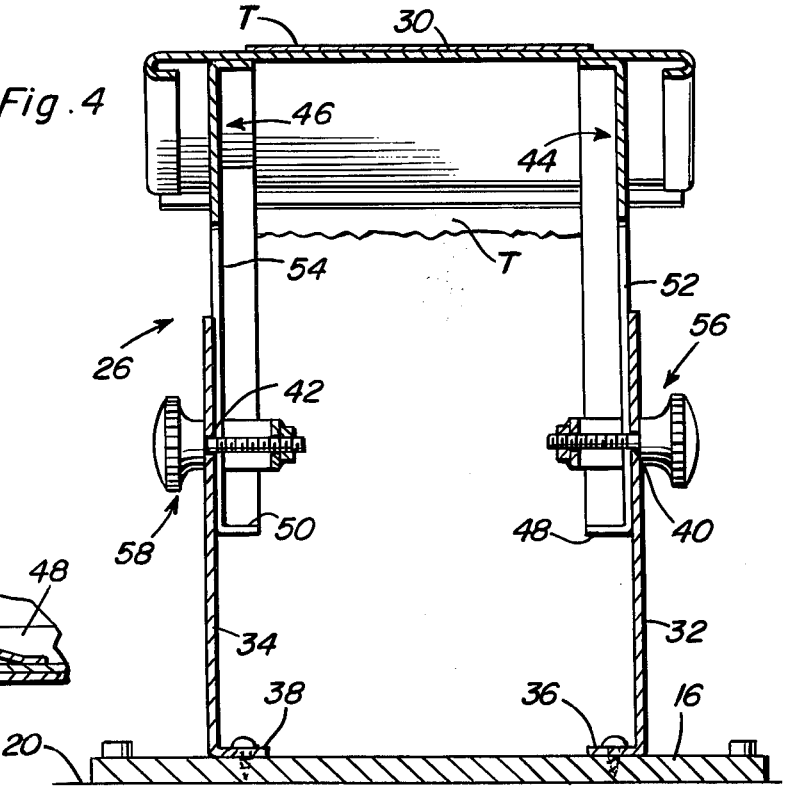
FIG. 4 is a sectional view taken generally along the line 4—4 of FIG. 3.
Figure 5:
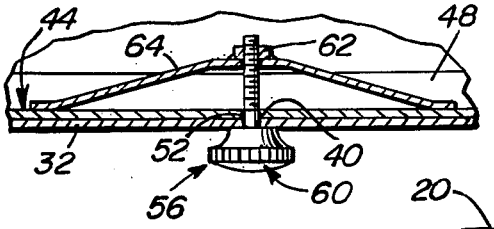
FIG. 5 is an enlarged, fragmentary, sectional view taken generally along the line 5—5 of FIG. 1.

Referring now more particularly to FIGS. 4 and 5 of the drawings in addition to FIGS. 1-3, it can be seen that table 26 also includes a pair of co-directionally extending, spaced stands 32 and 34 arranged abutting with and fastened to base 12, more specifically segment 16 thereof, as by the flanges 36 and 38, respectively, and suitable screw fasteners. Each of the stands 32 and 34 is disposed extending upwardly, and is provided with an aperture 40, 42. Top portion 28 of table 26 includes two substantially parallel legs 44 and 46 extending downwardly from the tape support surface 30 with each of these legs 44, 46 terminating at their downward extent in a lip 48, 50 extending toward the other of the legs 46, 44, and also with a vertically, longitudinally extending slot 52, 54 which cooperates with the respective aperture 40, 42 to permit suitable fasteners 56, 58 to adjustably mount top portion 28 on the stands 32, 34.

Each of the fasteners 56, 58, with fasteners 56 being shown in detail in FIG. 5 is typical also of fastener 58, includes a thumb screw 60 dimensioned for fitting through aperture 40 and slot 52 and threadedly engaging in a nut 62 affixed to a leaf spring 64. As will be appreciated, screw 60 will tighten spring 64 against the associated leg 44 while itself tightening against stand 32 so as to retain top portion 28 in a desired position relative to base 12. The lips 48 and 50 associated with legs 44 and 46 prevent fasteners 56, 58 from sliding out at the bottom portion of the associated slots 52, 54.

The aforementioned manner of mounting top portion 28 on stands 32 and 34 also permits top portion 28 to be tilted as shown by the arrows in FIG. 3 in order to vary the angle of inclination of the tape support surface 30 with respect to the plane of base 12. Thus, the present invention permits compensation for the variation in the angle relative to the base of the tape T as same passes between the roller assemblies 22 due to the constant variation in the diameter of the rolls on the roller assemblies 22, 24 as the tape T is wound and unwound between the spools of the roller assemblies 22, 24.

Figure 6:
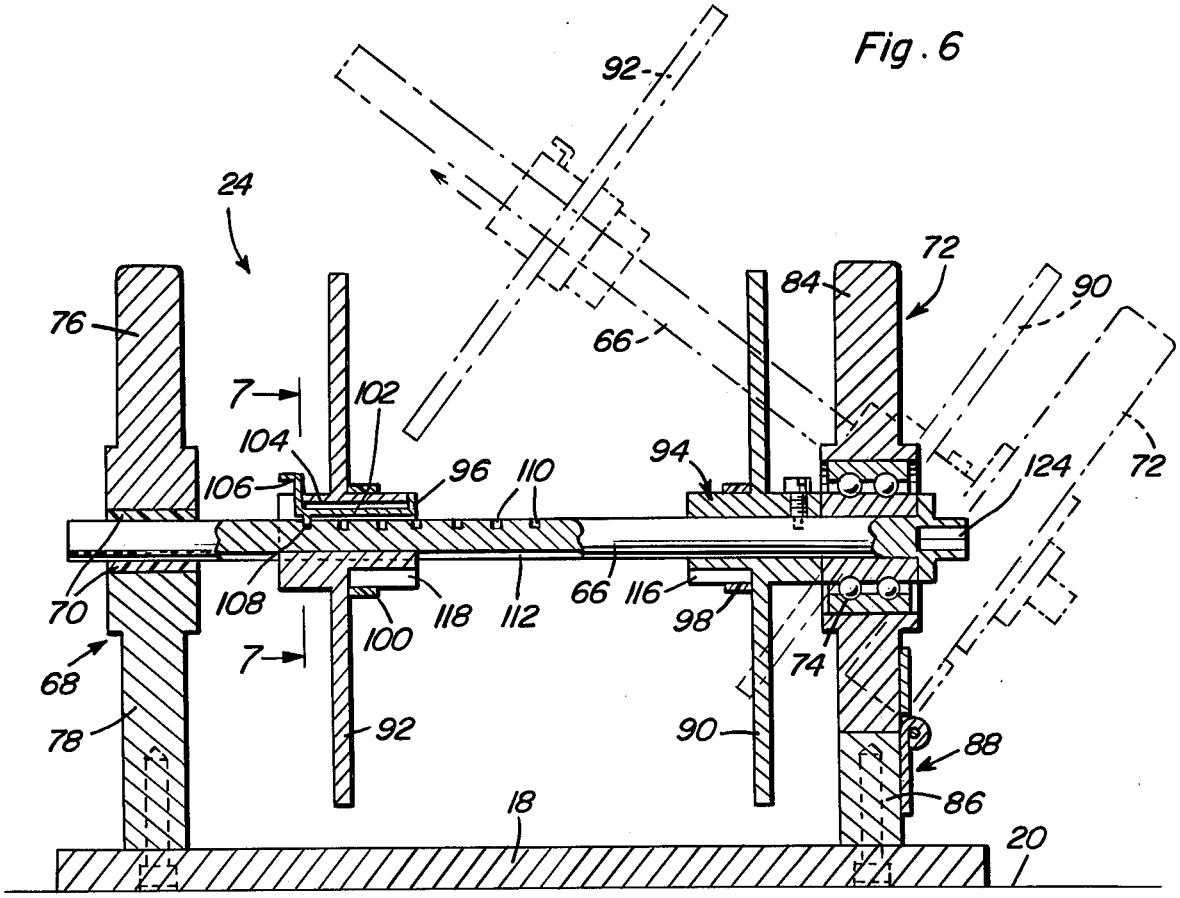
FIG. 6 is an enlarged, sectional view taken generally along the line 6—6 of FIG. 2.
Figure 7:
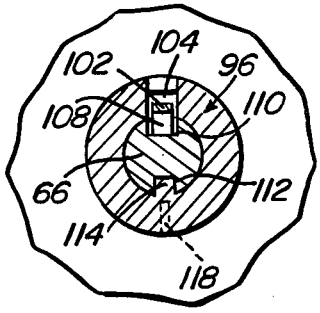
FIG. 7 is an enlarged, fragmentary, sectional view taken generally along the line 7—7 of FIG. 6.

Referring now more particularly to FIGS. 6 and 7 in addition to FIGS. 1-3 of the drawings, roller assembly 24 will now be described in detail. It will be understood that the only difference between roller assemblies 22 and 24 is that assembly 22 extends to a greater height above base 12 than assembly 24, so that the description of assembly 24 also describes assembly 22.

Roller assembly 24 includes a shaft 66 having two longitudinally spaced ends and partially forming a spool in conjunction with guide members to be described below. A first side wall 68 is mounted on and disposed extending upwardly from base 12, with a split bearing 70 being formed in the first side wall for journaling one of the ends of shaft 66. A second side wall 72 is mounted on and disposed extending upwardly from base 12 in a position opposed to but spaced from side wall 68. Side wall 72 is provided with a bearing 74 formed therein for journaling the other of the ends of shaft 66. First side wall 68 is split into two sections 76 and 78 so as to partially form half of the split bearing 70 in each of the sections 76, 78. The latter are pivotally joined together as by a conventional hinge 80 seen in FIG. 1. Section 76, that being uppermost of the two sections, is thus arranged for swinging laterally of shaft 66 and permit shaft 66 to be swung into and out of the half of bearing 70 formed in section 78. A suitable latch 82 releasably connects together the sects 76 and 78 at the edge of the seam between same spaced across the bearing 70 from hinge 80 so as to secure the halves of bearing 70 together when roller assembly 24 is in an operating mode.

In a like manner to side wall 68, side wall 72 is split into two parts 84 and 86, but the split is made adjacent base 12 such that bearing 74 is an integral bearing included entirely in the part 84. A hinge 86 extends longitudinally along the side wall 72 at the seam between parts 84 and 86 for pivotally connecting together these parts, with part 84 being arranged for swinging away from side wall 68. By this arrangement, as can be seen from the broken lines in FIG. 6, shaft 66 can be swung away from its seat in the lower half of bearing 70 for facilitating placement of a roll of paper, and the like, and its removal from shaft 66.

Roller assembly 24 further includes a primary plate 90 and a secondary place 92, each of these plates 90, 92 being provided with a hub 94, 96, respectively, arranged for receiving shaft 66. While secondary plate 92 is slidably disposed on shaft 66, primary plate 90 is intended to be removably affixed to shaft 66 as by the illustrated screws. Further, collars 98 and 100, constructed from a suitable resilient material, such as natural or synthetic rubber, are provided in the inwardly arranged portions of hubs 94 and 96, respectively, for keeping the tube on which the roll of paper, and the like, is wound firmly against the primary plate 90, the latter being driven in a suitable manner to be discussed below. These collars 98 and 100 will also provide clearance between the tape T on a roll disposed on shaft 66 and the plates 90 and 92.

Secondary plate 92 is selectively restrained along the longitudinal extent of shaft 66 by a locking device provided on hub 96. This locking device includes a leaf spring 102 cantilever mounted with a cavity 104 formed within hug 96 so as to extend longitudinally of shaft 66, and terminating in a lever 106 permitting a projection 108 provided on spring 102 to be selectively withdrawn against the bias of leaf spring 102 from one of a plurality of recesses 110 provided in the circumference of shaft 66. As can be appreciated, once projection 108 is withdrawn from one of the recesses 110 by an upward movement of lever 106, hub 96, and therefore secondary plate 92, can be moved axially along shaft 66 to a desired position corresponding to the width of a roll of paper (not shown) placed on shaft 66.

A groove 112 is provided longitudinally of the extent of shaft 66 for slidably receiving a key 114 formed in the interior of hub 96, and arranged so as to be substantially diametrically opposed to spring 102, for permitting secondary plate 92 to slide relative to shaft 96 while still requiring plate 92 to rotate with the shaft 66. Further, slots 116 and 118 are advantageously provided in the inwardly facing portions of hubs 94 and 96 for receiving an end of the tape T, or other endless web, when the particular roller assembly 22, 24 is being used as a take-up reel.

Hand wheels 120 and 122 are shown in broken lines in FIG. 2 as mounted on the shaft 66 of the roller assemblies 22 and 24 at an end thereof adjacent the associated second side wall 72. A suitable seat 124 (FIG. 6) is advantageously provided in the end of the shaft 66 at that point for permitting selective attachment and disattachment of the hand wheel 120, 122. It is also to be understood that a suitable motor (not shown) may be attached to at least one of the shafts 66 in order to permit rapid winding and unwinding of a roll to be edited.

OPERATION

The upper section 76 of a first side wall 66 of roller assembly 22 is first unlocked by releasing latch 82 and swung over on hinge 80 so that the shaft 66 can be lifted and the entire spool assembly swung up and around on hinge 88. Secondary ring 92 is now released from shaft 60 by lifting the spring 102 by means of lever 106 in order to disengage the integral lug or projection 108 from whatever one of the recesses 110 it happens to be disposed extending into. A selected roll of tape, and the like, is then slipped over the inner portion of hub 94 and pushed into contact with the small resilient collar 98 associated with primary plate 90. The secondary plate 92 is now replaced and pushed inwardly along shaft 66 until the collar 100 associated therewith contacts the roll, with the projection 108 of spring 102 automatically coming to rest within an adjacent one of the recesses 110 due to the bias of spring 102 in that direction. It may be necessary to hold lever 106 away from shaft 66 while secondary plate 92 is being pushed toward the paper roll in order to prevent projection 108 from engaging the plurality of recesses 110 disposed along the way. The plates 90 and 92, and therefore the paper roll due to the frictional engagement thereof with the resilient collars 98 and 100, will revolve with shaft 66 by means of screws affixing the primary plate 90 to shaft 66 and the interlocking lateral key way formed by groove 112 and key 114 provided on hub 96 of secondary plate 92. The entire assembly can now be angled back down into the lower half of the split bearing 70, which lower half is that provided in the section 78, and locked into place by swinging the hinged top section 76 of side wall 68 back into position abutting with section 78. Latch 82 will now retain the sections 76 and 78 in position in which the two halves of the split bearing 70 form a continuous bearing. Although an integral bearing 74 has been shown as fitting into a suitable opening provided in side wall 72, it is to be understood that a split bearing construction similar to that found in side wall 68 may be employed if desired. The free end of the tape T is now inserted into the slots 116 and 118 provided in the roller assembly 24, and the shaft 66 of assembly 24 can be appropriately rotated in order to cause the tape T to be wound unto the roller assembly 24 from the assembly 22.

The shaft 66 can be removed entirely from the bearing 74 and replaced with one of a different configuration as desired. Further, a snap-end pulley (not shown) may be inserted into seat 124 in place of the illustrated hand wheels, or hand cranks 120 and 122, both of which also may be provided with a square lug to engage the square seat 124 illustrated in FIG. 6. Both the lug and seat 124 may be slightly tapered to assure a snap-end engagement. In dual-unit operation (not shown) an elastic slip-on belt of conventional construction may be used in conjunction with the aforementioned pulleys and placed in either straight oval or FIG. 8 configuration for reversal of the direction of rotation of the two rollers. That is, the roller assemblies 22 and 24 would thus rotate in opposite directions. The belt may be directly rotated by an interposed motor (not shown) providing a third drive pulley, or by an alternate concentric double pulley (not shown) with a separate, second belt.

If the paper is small on the upper roller assembly 22, the table 26 can be arranged more horizontal since it is supported by the spring fasteners 56 and 58 that hold the top portion 28 of table 26 between the two upright stands 32 and 34. As the tape T moves to a different position with more on the upper or higher roller assembly 22 and less on the lower roller assembly 24, the inclination of the tape support surface 30 can be inclined to accommodate the varied position of the paper, and in this manner prevents strain on the paper tape which is somewhat easily torn in many cases. Not all papers used for this purpose are of the same weight of stock.

The reading and notation table 26 is provided to enable notations to be made without undue stress on the tape T, and is usually retracted unless it is needed to make notations. As needed, it is adjusted to accommodate the position of tape T. This protects the original journal entries in readily readable form.

SUMMARY

As can be appreciated from the above description and from the drawings, a register tape editor according to the present invention provides a simple yet efficient unit for quickly and easily reviewing and editing various business and scientific strip recordings. Auditors, for example, will find the invention very helpful in reviewing the original records of any business that uses roll tapes as a read-out of its business records. Further, the invention can be readily adapted for use as a toy by children to endlessly review pictures of various animals, symbols and the like, and even musical scales and chords can be readily learned by using the invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A register tape editor, comprising, in combination:
(a) a supporting base;
(b) first and second roller assemblies rotatably mounted in spaced, substantially parallel arrangement on the base; and
(c) reading and notation table means disposed between the first and second roller assemblies for supporting a length of tape extending between the roller assemblies, the latter winding and unwinding the tape from one of the roller assemblies to the other across the reading and notation table means, the reading and notation table means being adjustable vertically with respect to the supporting base of the editor, one of the first and second roller assemblies has an axis of rotation disposed vertically from the supporting base a greater distance than an axis of rotation of the other of the roller assemblies, with the reading and notation table means including a top portion forming an inclined tape support surface arrangeable substantially parallel to a plane assumed by the length of tape extending between the roller assemblies, the table means further including a pair of co-directionally extending, spaced stands arranged abutting with and fastened to the supporting base, with the stands being disposed extending upwardly, each of the stands being provided with an aperture, the top portion of the table means including two substantially parallel legs extending downwardly from the tape support surface, each of the legs being provided with a longitudinally extending slot cooperating with an aperture to form a pair of sets of apertures and slots, and fastener means engaging both sets of each of the cooperating apertures and slots for adjustably mounting the top portion of the top means on the stands.

2. A structure as defined in claim 1, wherein each of the roller assemblies includes, in combination:
(1) a shaft having two ends and partially forming a spool;
(2) a first side wall mounted on and disposed extending upwardly from the base, a bearing formed in the first side wall for journaling one of the ends of the shaft; and
(3) a second side wall mounted on and disposed extending upwardly from the supporting base, the second side wall being spaced from the first side wall and having a bearing formed in the second side wall for journaling the other of the ends of the shaft.

3. A structure as defined in claim 2, wherein the first side wall is split into two sections, the bearing formed in the first side wall being a split bearing partially formed by each of the sections, and a first hinge mounted on and pivotally connecting together the two sections, the one of the sections uppermost being arranged for swinging laterally of the shaft and permitting the shaft to swing upwardly away from a half of the split bearing associated with the lowermost of the sections, with the second side wall being split into two parts along a seam disposed between the bearing formed in the second side wall and the supporting base, and a second hinge mounted on and pivotally connecting together the two parts, the one of the parts uppermost being arranged for swinging away from the first side wall and permitting the shaft to swing away from the split bearing.

4. A structure as defined in claim 2, wherein the roller assemblies each include a primary plate and a secondary plate, each plate being provided with a shaft receiving hub, the primary plate being affixed to the shaft adjacent the second side wall, and the secondary plate being slidably disposed on the shaft, with locking means being provided on the hub of the secondary plate for selectively restraining the secondary plate from movement relative to the shaft.

5. A structure as defined in claim 4, wherein the first side wall is split into two sections, the bearing formed in the first side wall being a split bearing partially formed by each of the sections, and a first hinge mounted on and pivotally connecting together the two sections, the one of the sections uppermost being arranged for swinging laterally of the shaft and permitting the shaft to swing upwardly away from a half of the split bearing associated with the lowermost of the sections, with the second side wall being split into two parts along a seam disposed between the bearing formed in the second side wall and the supporting base, and a second hinge mounted on and pivotally connecting together the two parts, the one of the parts uppermost being arranged for swinging away from the first side wall and permitting the shaft to swing away from the split bearing.

6. A structure as defined in claim 1, wherein the roller assemblies each include a shaft, a primary plate, and a secondary plate, each plate being provided with a shaft receiving hub, with the primary plate being affixed to the shaft and the secondary plate being slidably disposed on the shaft, with locking means being provided on the hub of the secondary plate for selectively restraining the secondary plate from movement relative to the shaft.

7. A register tape editor, comprising, in combination:
(a) a supporting base;
(b) first and second roller assemblies rotatably mounted in spaced, substantially parallel arrangement on the base; and
(c) reading and notation table means disposed between the first and second roller assemblies for supporting a length of tape extending between the roller assemblies, the latter winding and unwinding the tape from one end of the roller assemblies to the other across the reading and notation table means, one of the first and second roller assemblies having an axis of rotation disposed vertically from the supporting base a greater distance than an axis of rotation of the other of the roller assemblies, with the reading and notation table means including a top portion forming an inclined tape support surface arrangeable substantially parallel to a plane assumed by the length of tape extending between the roller assemblies, the table means further including a pair of co-directionally extending, spaced stands arranged abutting with and fastened to the supporting base, with the stands being disposed extending upwardly, the top portion of the table means including two substantially parallel legs extending downwardly from the tape support surface and attached to respective ones of the stands, each of the roller assemblies including, in combination:

(1) a shaft having two ends and partially forming a spool;

(2) a first side wall mounted on and disposed extending upwardly from the base, a bearing formed in the first side wall for jounaling one of the ends of the shaft; and (3) a second side wall mounted on and disposed extending upwardly from the supporting base, the second side wall being spaced from the first side wall and having a bearing formed in the second side wall for journaling the other of the ends of the shaft.

8. A structure as defined in claim 7, wherein the first side wall is split into two sections, the bearing formed in the first side wall being a split bearing partially formed by each of the sections, and a first hinge mounted on and pivotally connecting together the two sections, the one of the sections uppermost being arranged for swinging laterally of the shaft and permitting the shaft to swing upwardly away from a half of the split bearing associated with the lowermost of the sections, with the second side wall being split into two parts along a seam disposed between the bearing formed in the second side wall and the supporting base, and a second hinge mounted on and pivotally connecting together the two parts, the one of the parts uppermost being arranged for swinging away from the first side wall and permitting the shaft to swing away from the split bearing.

9. A structure as defined in claim 7, wherein the roller assemblies each include a primary plate and a secondary plate, each plate being provided with a shaft receiving hub, the primary plate being affixed to the shaft adjacent the second side wall, and the secondary plate being slidably disposed on the shaft, with locking means being provided on the hub of the secondary plate for selectively restraining the secondary plate from movement relative to the shaft.

10. A structure as defined in claim 9, wherein the first side wall is split into two sections, the bearing formed in the first side wall being a split bearing partially formed by each of the sections, and a first hinge mounted on and pivotally connecting together the two sections, the one of the sections uppermost being arranged for swinging laterally of the shaft and permitting the shaft to swing upwardly away from a half of the split bearing associated with the lowermost of the sections, with the second side wall being split into two parts along a seam disposed between the bearing formed in the second side wall and the supporting base, and a second hinge mounted on and pivotally connecting together the two parts, the one of the parts uppermost being arranged for swinging away from the first side wall and permitting the shaft to swing away from the split bearing.

11. A roller assembly for winding and unwinding a tape, comprising, combination:

(a) a shaft having two ends and partially forming a spool;

(b) a first side wall extending upwardly from a support surface, with a bearing being formed in the first side wall for journaling one of the ends of the shaft; and (c) a second side wall extending upwardly from the support surface and spaced from the first side wall, the second side wall having a bearing formed therein for journaling the other of the ends of the shaft, the first side wall being split in two sections, the bearing formed in the first side wall being a split bearing partially formed by each of the sections, and a first hinge mounted on and pivotally connecting together the two sections, the one of the sections being furthest away from the support surface being arranged for swinging laterally of the shaft, with the second side wall being split into two parts between the bearing formed in the second side wall and the support surface, and a second hinge mounted on and pivotally connecting together the two parts, the one of the parts furthest from the support surface being arranged for swinging away from the first side wall and permitting the shaft to swing out of the split bearing.

12. A structure as defined in claim 11, wherein the roller assemblies each include a primary plate and a secondary plate, each plate being provided with a shaft receiving hub, the primary plate being affixed to the shaft adjacent the second side wall, and the secondary plate being slidably disposed on the shaft, with locking means being provided on the hub of the secondary plate for selectively restraining the secondary plate for movement relative to the shaft.

* * * * *